US007984904B2

(12) United States Patent
Bakker et al.

(10) Patent No.: US 7,984,904 B2
(45) **Date of Patent: *Jul. 26, 2011**

(54) DOCUMENT PROCESSING SYSTEM WITH MECHANISM FOR DETECTING STAPLES, PAPER CLIPS, AND LIKE FOREIGN ITEMS

(76) Inventors: Johan P. Bakker, Brighton, MI (US); J. Michael Spall, Oakland, MI (US); Thomas J. Shelton, Canton, MI (US)

( * ) Notice: Subject to any disclaimer, the term of this patent is extended or adjusted under 35 U.S.C. 154(b) by 157 days.

This patent is subject to a terminal disclaimer.

(21) Appl. No.: 12/327,956

(22) Filed: Dec. 4, 2008

(65) Prior Publication Data

US 2010/0140865 A1 Jun. 10, 2010

Related U.S. Application Data

(62) Division of application No. 11/433,738, filed on May 12, 2006, now Pat. No. 7,556,265.

(51) Int. Cl.
*B65H 7/02* (2006.01)

(52) U.S. Cl. ..... 271/258.01

(58) Field of Classification Search ..... 271/256, 271/258.01; 347/104; 73/159, 572
See application file for complete search history.

(56) References Cited

U.S. PATENT DOCUMENTS

| | | | | |
|---|---|---|---|---|
| 5,646,794 | A | 7/1997 | Lindsay, Jr. et al. | |
| 5,727,692 | A * | 3/1998 | Large et al. | 209/603 |
| 5,962,861 | A | 10/1999 | Fowler | |
| 6,114,646 | A | 9/2000 | Montgomery | |
| 6,409,329 | B1 | 6/2002 | King | |
| 7,407,091 | B2 | 8/2008 | Graef et al. | |
| 2003/0067107 | A1 | 4/2003 | Ikeda | |
| 2006/0159470 | A1 | 7/2006 | Yasukawa et al. | |
| 2007/0034683 | A1 | 2/2007 | Eastman et al. | |
| 2007/0257099 | A1 | 11/2007 | Graef et al. | |

* cited by examiner

*Primary Examiner* — Michael C McCullough
(74) *Attorney, Agent, or Firm* — Honigman Miller Schwartz and Cohn LLP

(57) ABSTRACT

A document processing system includes a document track composed of a pair of opposing rigid track walls. The documents are moved along the document track in a series to allow operations to be performed on the documents. An apparatus for detecting a document with an attachment includes a strike plate formed by a separate section of a wall of the document track. A magnet is arranged to attract material toward the strike plate. An accelerometer is mounted to the strike plate. The accelerometer detects an impact of an attachment to the strike plate when a document with an attachment passes the strike plate.

9 Claims, 2 Drawing Sheets

DOCUMENT PROCESSING SYSTEM WITH MECHANISM FOR DETECTING STAPLES, PAPER CLIPS, AND LIKE FOREIGN ITEMS

CROSS REFERENCE TO RELATED APPLICATIONS

The present disclosure is a Divisional Patent Application claiming priority to U.S. Ser. No. 11/433,738 filed on May 12, 2006, the disclosure of which is hereby incorporated by reference.

BACKGROUND OF THE INVENTION

1. Field of the Invention

The invention relates to document handling equipment including systems for feeding and transporting documents. The invention further relates to detecting the presence of staples, paper clips, and like foreign items in a stream of continuously-fed moving paper items in a document processing system.

2. Background Art

A typical system for feeding and transporting documents includes a feeder in the document feeding portion of the system, and a series of roller pairs or belts in the document transporting portion of the system. In the feeding portion of the system, the feeder acts to separate and feed documents singly, in order, from a stack. In the transporting portion of the system, the roller pairs and/or belts convey the documents, one at a time, through a track past other processing devices such as readers, printers, and sorters that perform operations on the documents. The feeder is typically a feed wheel, but may take other forms. Further, the components in the transporting portion of the system may take a variety of forms. Operations that depend on the position of the document are generally performed in the transport stage, or transporting portion of the system.

Typically, the document track has drive rollers and pinch rollers positioned along the document path to propel a document down the track. The document track sidewalls are usually rigid and non-movable. The document track is narrow and deep, typically with only the top portion of a document visible, or with no document visibility at all.

Workers in the art of high-speed document processing will be familiar with the problems which are caused when the documents to be processed include attachments such as staples and paper clips. These attachments are inevitable and unavoidable when the documents being processed include, for example, financial documents, checks, remittances, and the like.

In machines which are designed to feed, move and process document items at high speeds and rates, such attachments can be very destructive. For example, in a machine designed to read magnetically-encoded characters on bank checks, a single metal staple can destroy the magnetic air-gap read head which is required for such reading. Such an event may lead to costly repairs and down-time.

For these reasons, makers of document-processing machinery have sought to either eliminate staples and the like from the documents to be processed, or to detect their presence before they can do damage. For example, an existing financial document processor includes an electromagnetic staple-detect feature which scans each item as it is fed and moved, detects the presence of any metallic attachment, and stops the machine before the attachment can do damage.

The existing approaches for detecting staples and other metallic attachments have been successful; however, there are opportunities for improvement. For example, the detection mechanism may involve the use of complex and costly electromagnetic sensing heads, which typically operate by applying a significant magnetic field (by means of a permanent magnet) and then sensing changes in the applied field using a series of electrical sense coils. Because an attachment can be in any physical orientation, multiple sense coils in multiple orientations are usually required to ensure that all attachments will be sensed. Such sensing heads become both physically large and complex, and also very costly, if they are to perform well.

An alternative approach for detecting staples includes the provision of an energized or oscillating sense coil or coils, through the center of which the documents to be processed are passed. The presence of an attachment is sensed by variations in the magnetic field or oscillations of the sense coils, according to known principles. Such an approach suffers from the drawback that a sense coil must completely encircle the document and the track in which the document travels, hindering service and error-recovery attention. Such sensing approaches also tend to require complex and delicate signal-conditioning electronics to function reliably, and may also create problems of electromagnetic interference (EMI) or radio-frequency interference (RFI), which are subject to regulatory control and sanction.

For the foregoing reasons, there is a need for an improved approach to detecting staples, paper clips, and like foreign items in a stream of continuously-fed moving paper items that overcomes some of the limitations of existing approaches.

SUMMARY OF THE INVENTION

It is an object of the invention to provide an improved document processing system including a mechanism for detecting staples, paper clips, and like foreign items.

A document processing system for feeding and transporting documents includes a feeder stage and a transport stage. The feeder stage includes a hopper assembly and a feeder. The feeder acts to feed documents singly, in order, from a stack of documents in the hopper assembly. The transport stage is downstream of the feeder stage for receiving the fed documents. The transport stage includes a document track composed of a pair of opposing track walls. During transportation, the documents are moved along the document track in a series to allow operations to be performed on the documents.

In accordance with the invention, there is a separate section of the wall of the document track; this separate wall section is mounted separate from the surrounding walls to form a resonator or strike plate. This separate wall section is preferably of relatively low mass and mounted using low-damping mounts. In addition, the strike plate is preferably metallic, and made of either a non-magnetic or para-magnetic material, such as a suitable alloy of stainless steel or one of the high-nickel steel alloys known by the collective tradename of DYNAVAR.

In more detail, a magnet is arranged to attract materials toward the strike plate. In a preferred arrangement, a powerful permanent magnet is mounted somewhat-separate from the strike plate on the side of the strike plate that is opposite the side which is towards the passing documents. An accelerometer is mounted to the strike plate. In a preferred arrangement, the accelerometer is mounted on the same side as the magnet and is oriented so as to have its primary sensing axis perpendicular to the face of the passing documents. The accelerometer may be a conventional piezoelectric accelerometer. The accelerometer is connected to the control system of the document processing system. In a suitable arrangement, the accelerometer is connected to the control system via a conventional charge-amplifier and appropriate signal conditioning circuitry.

In operation of the document processing system, when a document passes the strike plate, it may or may not slide against the strike plate, depending on the shape, thickness, and condition of the document. In this situation, the signal obtained from the accelerometer is low and random, and amounts to background noise.

However, when a document with an attached staple, paper clip, or other foreign item passes the strike plate, the attachment strikes the plate either due to either the shape, thickness, and condition of the document or because the magnet attracts the attachment toward the plate. In turn, the accelerometer detects the impact of the attachment on the strike plate. The signal at the accelerometer is a very sharp, narrow signal spike. This signal spike is typically of much larger amplitude than the background noise. As well, the slope of the signal spike is much greater than any of the background noise signals.

Accordingly, the signal spike at the accelerometer that occurs when the attachment impacts the strike plate can easily be differentiated from the background noise. The signal spike, suitably amplified and conditioned, is then used to report to the control system of the document processor that an attachment has been detected. The control system then initiates an appropriate action such as, for example, halting the flow of documents to allow manual operator intervention.

DETAILED DESCRIPTION OF THE PREFERRED EMBODIMENT

Figure 1:
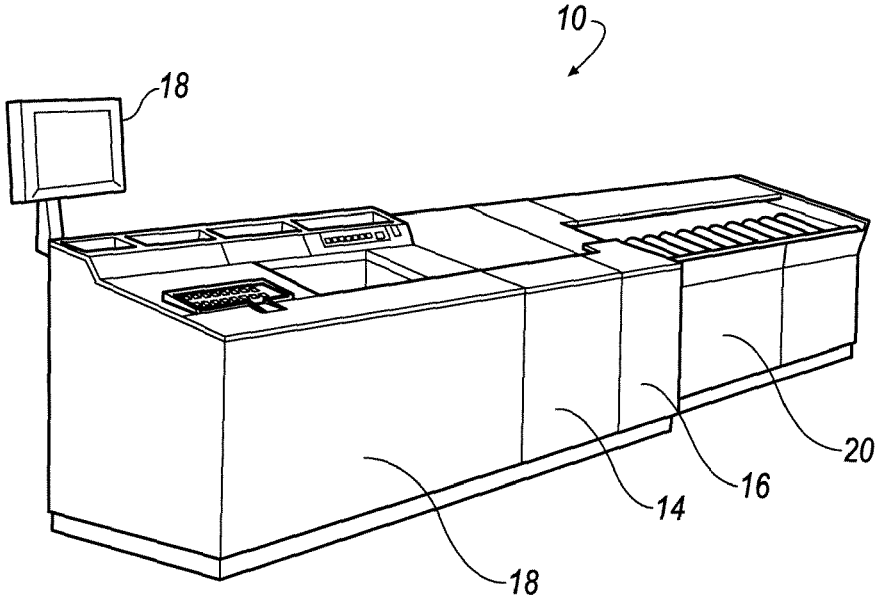
FIG. 1 illustrates a document processing system made in accordance with the invention.

FIG. 1 illustrates a document processing system for feeding and transporting documents at 10. System 10 includes various modules and components and is shown in a typical configuration. System 10 includes main unit 12 which includes a document feeder, a document reader, an operator interface, and a multi-jet endorser (MJE). The feeder acts to separate and feed documents singly, in order, from a stack. The remainder of system 10 is the transporting portion of the system, and includes a number of roller pairs and/or belts to convey the documents, one at a time, through a track past other processing devices that perform operations on the documents.

In the illustrated configuration, a high speed encoder module 14 and an image module 16 are arranged downstream of unit 12. The operator display is indicated at 18. Finally, an 8-pocket stacker module 20 is provided for the actual sorting of the documents into pockets. The stacker module is expandable to 40 or 48 pockets. FIG. 1 illustrates an exemplary system, which is depicted as an NDP document processor available from Unisys.

Figure 2:
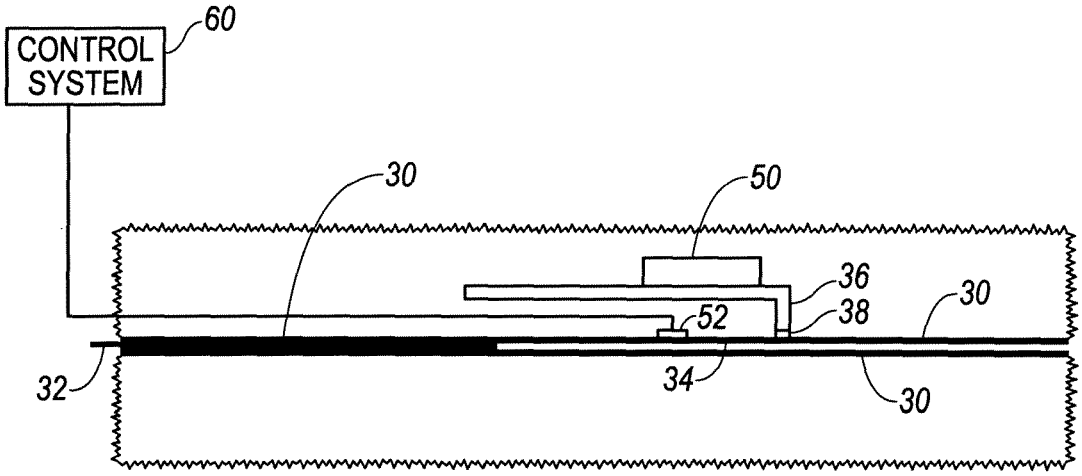
FIG. 2 illustrates an enlarged plan view of a portion of the document track, including the strike plate, magnet, and accelerometer arrangement.

FIG. 2 illustrates an enlarged plan view of a portion of the document track. The document track is composed of a pair of opposing rigid track walls 30. Drive rollers and pinch rollers (not specifically shown) positioned along the document path propel documents down the track. In FIG. 2, document 32 is shown traveling down the document track.

In accordance with the invention, staples, paper clips, and like foreign items attached to documents are detected before they can do damage. A strike plate 34 is formed by a separate section of a wall of the document track. The separate wall section forming strike plate 34 is mounted separate from the surrounding walls. Mounting assembly 36 holds strike plate 34 in the appropriate position along the document track. Preferably, strike plate 34 is of relatively low mass and mounted using low-damping mounts 38. In this way, strike plate 34 forms a resonator. Strike plate 34 is preferably made of metal. Strike plate 34 is preferably made of either a non-magnetic or para-magnetic material, such as a suitable alloy of stainless steel or one of the high-nickel steel alloys known by the collective tradename of DYNAVAR.

A magnet 50 is arranged to attract materials toward strike plate 34. As shown, magnet 50 is a powerful permanent magnet mounted somewhat-separate from strike plate 34 on the side of strike plate 34 that is opposite the side which is towards the passing documents. An accelerometer 52 is mounted to strike plate 34. As shown, accelerometer 52 is mounted on the same side of strike plate 34 as magnet 50, and is oriented so as to have its primary sensing axis perpendicular to the face of the passing document. The accelerometer 52 may be a conventional piezoelectric accelerometer. Accelerometer 52 is connected to the control system 60 of the document processing system, via a conventional charge-amplifier and appropriate signal conditioning circuitry. Control system 60 controls the various modules and components of the document processing system such as the feeder and the drive rollers positioned along the document path.

In operation of the document processing system, documents are moved along the document track in a continuously-fed series to allow operations to be performed on the documents. When a document with an attached staple, paper clip, or other foreign item passes strike plate 34, the attachment strikes the plate either due to the shape, thickness, and condition of the document or because the magnet 50 attracts the attachment toward the strike plate 34.

Accelerometer 52 detects the impact of the attachment on strike plate 34. The response signal at the accelerometer 52 is a very sharp, narrow signal spike. The signal spike has a much larger amplitude than the background noise, and in addition, the slope of the signal spike is much greater than any of the background noise signals. In this way, the signal spike at accelerometer 52 that occurs when the attachment impacts strike plate 34 can easily be differentiated from the background noise. The amplified and conditioned signal is used to report to control system 60 that an attachment has been detected. Control system 60 may initiate an appropriate action such as, for example, halting the flow of documents to allow manual operator intervention.

Figure 3:
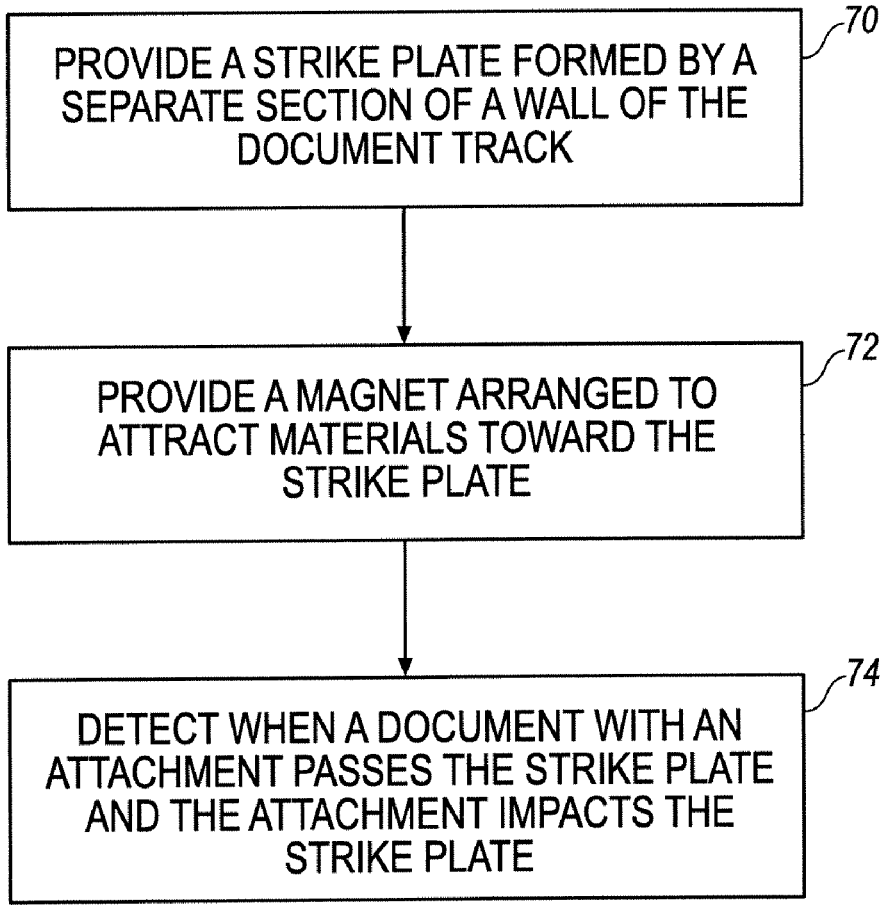
FIG. 3 is a block diagram illustrating a method of the invention.

A method of the invention is illustrated in the block diagram of FIG. 3. At block 70, a strike plate formed by a separate section of a wall of the document track is provided. At block 72, a magnet arranged to attract materials toward the strike plate is provided. At block 74, the impact of an attachment against the strike plate when a document with an attachment passes the strike plate is detected.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A method, comprising the steps of:

forming a first wall portion to include one wall section;

forming a second wall portion to include a first wall section and a second wall section, wherein the second wall section is separate from the first wall section;

arranging the first wall portion in an opposing relationship with respect to the second wall portion for forming a document-conveying track for permitting conveyance of at least one documents to be moved, in series, through the document-conveying track for permitting operations to be performed on the at least one documents;

utilizing the second wall section of the second wall portion as a resonator for generating a response signal including at least one of a first signal indicative of background noise associated with the at least one documents passing by the resonator and a second signal indicative of a detection of a document of the at least one documents including an attachment that passes the resonator, and mounting an accelerometer to the resonator for detecting the attachment against the resonator.

2. The method of claim 1 further comprising the step of:

positioning a magnet proximate the resonator for attracting the attachment toward the resonator.

3. The method of claim 1 further comprising the step of arranging a sensing axis of the accelerometer perpendicularly with respect to a face of a document of the at least one documents conveyed through the document-conveying track.

4. The method of claim 1 further comprising the step of:

connecting a control system to the accelerometer for permitting the control system to halt a flow of the at least one documents through the document-conveying track in response to the detection of the impact of the attachment against the resonator.

5. A method, comprising the steps of:

forming a first wall portion to include one wall section;

forming a second wall portion to include a first wall section and a second wall section, wherein the second wall section is separate from the first wall section;

arranging the first wall portion in an opposing relationship with respect to the second wall portion for forming a document-conveying track; and mounting an accelerometer to the second wall section for detecting an impact of an attachment against the second wall section, wherein the attachment is disposed upon a document of at least one documents being conveyed along the document-conveying track.

6. The method of claim 5 further comprising the step of:

positioning a magnet proximate the second wall section for attracting the attachment toward the second wall section.

7. The method of claim 5 further comprising the step of arranging a sensing axis of the accelerometer perpendicularly with respect to a face of a document of the at least one documents conveyed through the document-conveying track.

8. The method of claim 5 further comprising the step of:

utilizing the second wall section of the second wall portion as a resonator for generating a response signal including at least one of a first signal indicative of background noise associated with the at least one documents passing by the resonator, and a second signal indicative of a detection of a document of the at least one documents including the attachment that passes the resonator.

9. The method of claim 8 further comprising the step of:

connecting a control system to the accelerometer for permitting the control system to halt a flow of the one or more documents through the document-conveying track in response to the detection of the impact of the attachment against the resonator.

* * * * *

UNITED STATES PATENT AND TRADEMARK OFFICE

CERTIFICATE OF CORRECTION

PATENT NO. : 7,984,904 B2
APPLICATION NO. : 12/327956
DATED : July 26, 2011
INVENTOR(S) : Johan P. Bakker et al.

It is certified that error appears in the above-identified patent and that said Letters Patent is hereby corrected as shown below:

In the Claims:

Please correct Claim 1 as follows:

Column 5, claim number 1, line number 21, after the word detecting insert -- an impact of --.

Signed and Sealed this
Twenty-first Day of February, 2012

David J. Kappos

David J. Kappos
*Director of the United States Patent and Trademark Office*